United States Patent [19]

Battegazzore

[11] Patent Number: 4,821,926

[45] Date of Patent: Apr. 18, 1989

[54] DISPENSER OF PASTE-LIKE PRODUCTS, IN PARTICULAR TOOTHPASTE

[75] Inventor: Piero Battegazzore, Alessandria, Italy

[73] Assignee: Guala S.p.A., Italy

[21] Appl. No.: 176,855

[22] Filed: Apr. 4, 1988

[30] Foreign Application Priority Data

Apr. 10, 1987 [IT] Italy ..... 21386/[U]

[51] Int. Cl.[4] ..... B67D 5/42; G01F 11/00

[52] U.S. Cl. ..... 222/209; 222/145; 222/213; 222/380; 222/387

[58] Field of Search ..... 222/94, 129, 145, 207, 222/213, 209, 212, 256, 257, 259, 260, 321, 340, 341, 380, 383, 385, 386, 387, 391, 401, 402.12, 417, 405, 517

[56] References Cited

U.S. PATENT DOCUMENTS

| | | | |
|---|---|---|---|
| 3,268,123 | 8/1966 | Spatz | 222/400.5 |
| 3,414,169 | 12/1968 | Corsette | 222/321 |
| 3,469,746 | 9/1969 | Melocchi | 222/182 |
| 3,664,556 | 5/1972 | Perry et al. | 222/385 |
| 4,154,371 | 5/1979 | Kolaczinski | 222/212 |
| 4,456,153 | 6/1984 | Meshberg | 222/383 X |
| 4,691,849 | 9/1987 | Tada | 222/383 X |
| 4,776,496 | 10/1988 | Battegazzore | 222/209 |

FOREIGN PATENT DOCUMENTS

| | | | |
|---|---|---|---|
| 0214106 | 3/1987 | European Pat. Off. . | |
| 0224907 | 6/1987 | European Pat. Off. | 222/383 |
| 3545743 | 6/1987 | Fed. Rep. of Germany | 222/391 |
| 2146612 | 4/1985 | United Kingdom . | |

*Primary Examiner*—Kevin P. Shaver

*Attorney, Agent, or Firm*—Notaro & Michalos

[57] ABSTRACT

A dispenser of paste-like products, in particular toothpaste, is composed of a cylindrical container having a head, a bottom wall slidable tightly therein one way toward the head, a pumping membrane mounted inside it close to the head, a delivery conduit attached rigidly to the head and associated, through a part thereof, with a sleeve formed in one piece with the pumping membrane. The sleeve being therefore slidable tightly on the delivery conduit, and an actuating lever pivoted to the head for movement between a home position and a toothpaste dispensing end position. The lever acting on the sleeve to operate the pumping membrane, and a shutter connected to the sleeve by a plurality of small bridges held circumferentially apart from one another. The shutter being operative to close and open the delivery conduit at the inlet mouth thereof.

9 Claims, 7 Drawing Sheets

DISPENSER OF PASTE-LIKE PRODUCTS, IN PARTICULAR TOOTHPASTE

This invention relates to a dispenser of generic paste-like products, in particular toothpaste, of a type which comprises a cylindrical container having a vertical longitudinal axis, a head located at the container upper end, a bottom wall mounted for tight sliding movement inside the container in one direction toward the head, a pumping member mounted in the container close against the head, a sleeve having a free end and an opposed end associated with the pumping member, an actuating lever for moving the pumping member, trunnions protruding from the lever along a perpendicular pivot axis to the container longitudinal axis, said pivot axis being fixed relatively to the container, said lever being movable angularly about said pivot axis from a home position to a paste delivery position, trunnion bearing seats formed in the head for accommodating said trunnions, a delivery conduit having an inlet mouth and an outlet mouth and being mounted to the head, a covering eave formed integrally with said actuating lever and extending to cover the outlet mouth when the lever is at its home position, said actuating lever being provided with a cam profile for engagement in said free end of the sleeve, said tubular delivery conduit being connected to said sleeve by its inlet-side end for sliding movement in an axial direction, and said pumping member comprising a flexible annular membrane having an outward edge held axially to the cylindrical container and an inward edge connected to said sleeve.

A dispenser of the type specified above is described and illustrated in European Patent Application No. 86830205.0-2308.

While satisfactorily performing its basic toothpaste dispending function, that prior dispenser does tend to resist initial delivery of the toothpaste if a long storage period has been allowed to elapse from its original filling.

In fact, any toothpaste that at the time of filling the container got into the delivery conduit connected to the pumping member will tend to dry up and clog the conduit.

It has been found in actual practice that the eave associated with the actuating lever of the pumping member, while providing a cover for the delivery outlet and preventing the paste from flowing out, cannot provide an adequately tight closure to prevent any paste present in the delivery conduit from undergoing inceptive drying.

The problem, on which this invention is based, is therefore to so improve a dispenser of the type set forth above as to impart it with appropriate constructional and operational features to overcome the drawback noted above.

This problem is solved by a dispenser as indicated being characterized as set forth in claim 1.

The features and advantages of the invention will be apparent from the following detailed description of some preferred embodiments thereof, to be taken by way of example and not of limitation in conjunction with the accompanying drawings, where:

Figure 2:
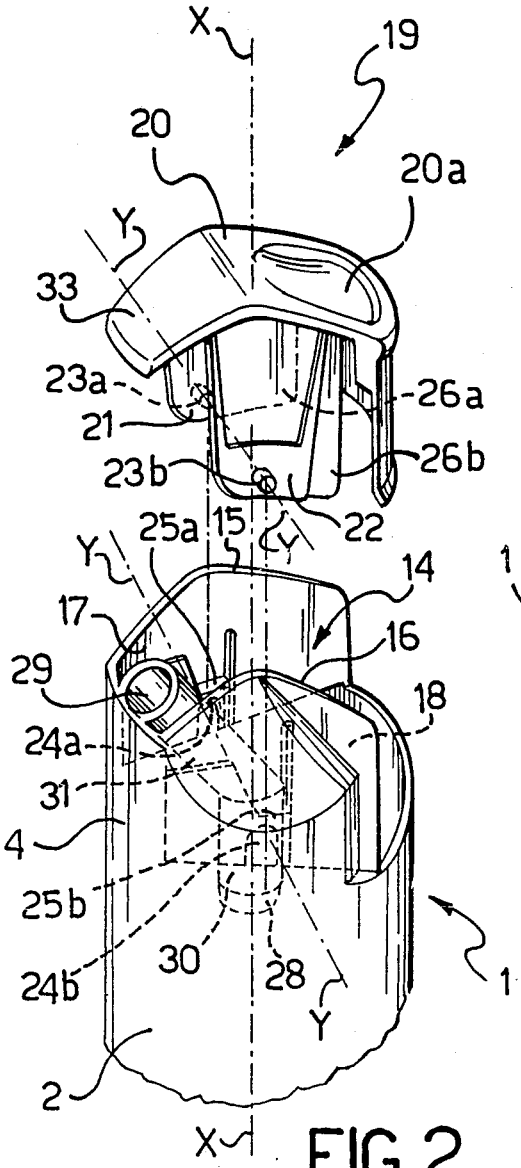
FIG. 2 is an exploded perspective view of the head assembly of the dispenser of FIG. 1.
Figure 1:
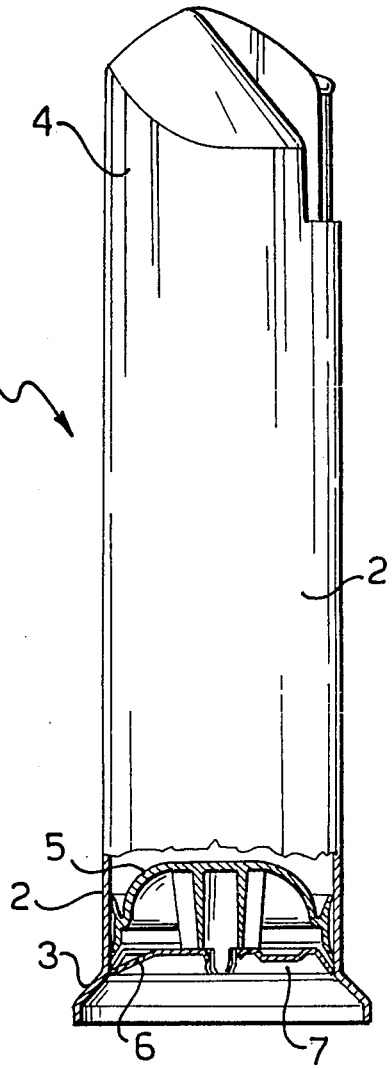
FIG. 1 is a part-sectional elevation view of a dispenser according to the invention.

With reference to the drawing views, the numeral 1 generally designates a dispenser according to the invention, adapted for containing and dispensing generic paste-like products, and in particular toothpaste.

The dispenser 1 comprises a tubular cylindrical container 2 having a vertical longitudinal axis X—X and, located at its lower end, an outward-facing annular flange 3 adapted to form a pedestal, and at its upper end, a head 4 formed integrally therewith.

Mounted in tight sealed relationship within the cylindrical container 2 for sliding movement therein is a dome-shaped bottom 5 which is movable unidirectionally from the pedestal 3 toward the head 4 on account of a Belleville washer type spring 6, attached to the bottom 5, having a downward facing outer rim arranged to engage with and push against the container 2. With the bottom 5 there is also associated an end cap 7 serving as an infill wall.

Mounted inside the cylindrical container 2 is a pumping member consisting of an elastic resilient membrane 10 located close against the head 4.

Contained between the membrane 10 and the bottom 5 is a toothpaste for dispensing.

The membrane 10 is annular and cup-like shaped with an inward edge 11 and an outward edge 12.

The outward edge 12 is held axially to the cylindrical container 2 by means of an inner annular ledge 13 formed in the wall of the container 2.

The inward edge 11 of the membrane 10 is in one-piece with a cylindrical sleeve-like element 9 coaxial with the longitudinal axis X—X of the container 2.

Formed in the thickness of the sleeve 9 is an annular groove 9a which is open downwards toward the bottom of the container 2. The groove defines a concentrical tubular wall 9b. The sleeve 9 becomes quite stiff on account of its shape.

The membrane 10 has instead a reduced thickness in order to be pliant and provide at the same time adequate elastic recovery.

The head 4 has a center opening 14 extended diametrically and delimited by opposing edges 15 and 16.

Two opposing walls 17 and 18 extend from said edges 15 and 16 of the head 4 inwardly of the container 2.

The dispenser 1 includes an actuating lever 19 for operating the pumping membrane 10. The lever 19 comprises a plate-like element 20 having two opposing wings 21 and 22 depending therefrom at right angles in spaced-apart mutual relationship for fitting loosely between the walls 17 and 18.

The actuating lever 19, which has an anatomically patterned portion 20a at the plate-like element 20 for handling it, is hinged about a horizontal axis Y—Y to the head 4 by two trunnions 23*a* and 23*b*, rigid with the wings 21 and 22 and projecting outwards therefrom, engaging in corresponding semicircular trunnion bearing seats 24*a* and 24*b* which are formed in the walls 17 and 18 aligned along the axis Y—Y.

Formed on those same walls, 17 and 18, are lead-in ramps 25*a* and 25*b* enabling the trunnions 23*a* and 23*b* to snap fit on assembling into their respective seats 24*a* and 24*b*.

The wings 21 and 22 are formed with respective cam profiles 26*a* and 26*b* arranged to act on the free end 9*c* of the sleeve 9 of the membrane 10.

Figure 3:
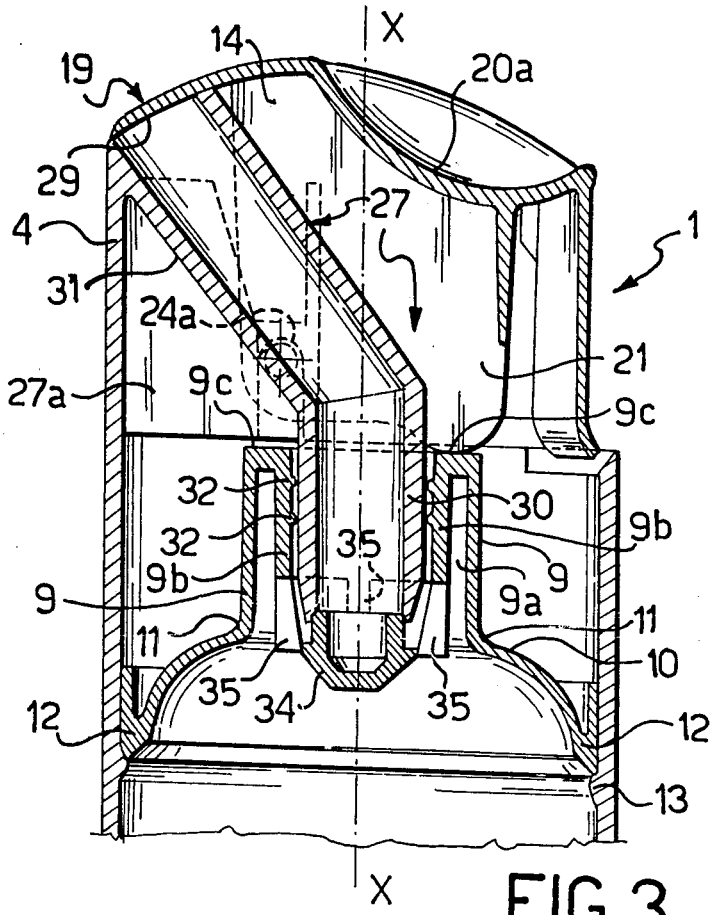
FIG. 3 is an enlarged scale sectional view of a first embodiment of the dispenser head assembly shown in FIG. 1.
Figure 5:
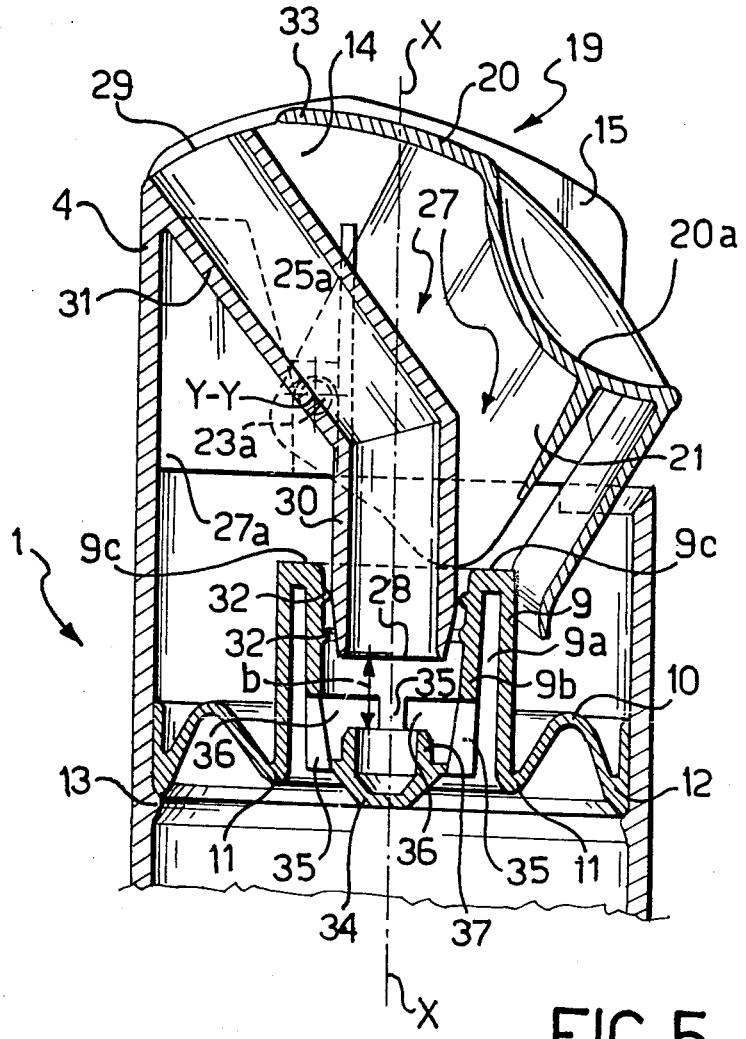
FIG. 5 is a sectional view of the device of FIG. 3, shown at a different stage of its operation.
Figure 6:
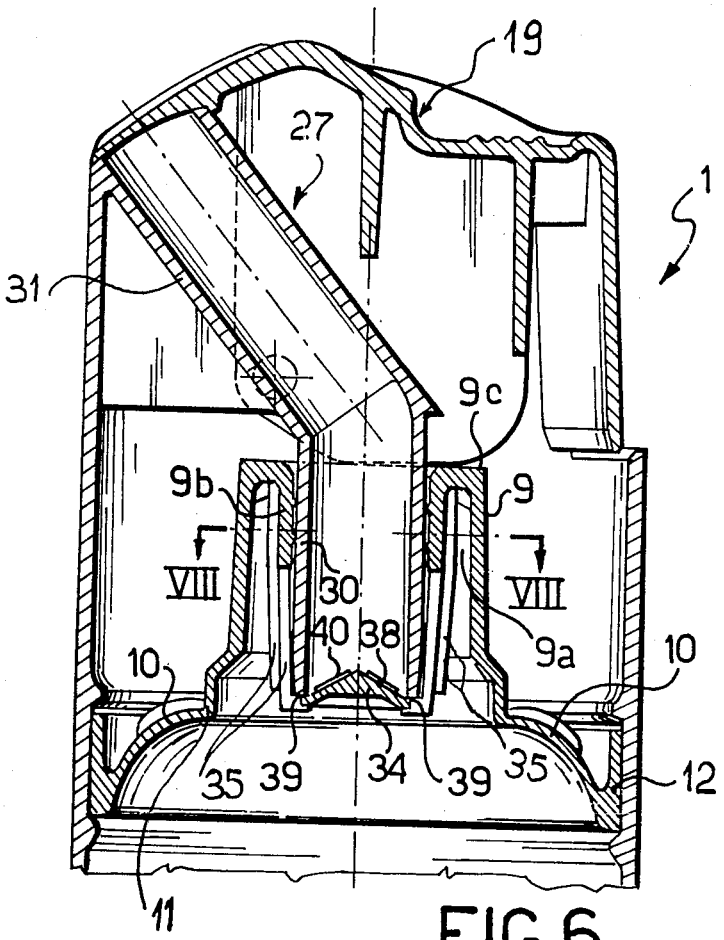
FIG. 6 is an enlarged scale sectional view of the head assembly of the dispenser of FIG. 1, according to a second embodiment thereof.

The lever 19 is movable angularly by pivoting it about the axis Y—Y defined by the trunnions 23*a* and 23*b*, from a home position shown in FIG. 3 to a travel limit position, shown in FIG. 5, where a predetermined amount of toothpaste has been fully dispensed.

The dispenser 1 further comprises a tubular delivery conduit 27 which is formed integrally with the head 4 and extends therethrough, it being stiffened by a radial rib 27*a*. The conduit 27 is connected to the sleeve 9 of the membrane 10. In particular, the conduit 27 has an inlet mouth 28 and an outlet mouth 29. It also has a first section 30, next to the inlet mouth 28, which extends coaxially with the axis X—X, and a second section 31 close to the outlet mouth 29, which lies at right angles to the first section 30. Said section 31 opens to the interior of the head 4 with the outlet mouth 29 level with the opening 14.

The sleeve 9 fits in a tight sliding manner over the section 30 of the conduit 27 via its inner tubular wall 9b which is formed with annular ribs 32 serving a sealing function.

An eave 33 consisting of a lug formed integrally with the plate-like element 20 is associated with the lever 19. The eave 33 is positioned above the outlet mouth 29 to fully cover it when the lever 19 occupies its home position, whence it is moved away to completely uncover the outlet mouth 29 upon the lever 19 moving past a predetermined intermediate position between the home and dispensing end positions. Said intermediate position would correspond to a dispensing start position.

Return of the lever 19, from the dispensing end position to the home position, is ensured by the elastic recovery of the pumping membrane 10 which acts on the cam profiles 26*a* and 26*b* of the wings 21 and 22 through the free end 9*c* of the sleeve 9.

The dispenser 1 of this invention also comprises a shutter 34 movable along the axis X—X toward and away from the inlet mouth 28 of the section 30 of the conduit 27 to block its passage.

The shutter 34 is rigid with the sleeve 9 to the tubular inner wall 9*b* whereof it is connected by means of small bridges 35 set a regular distances apart to define ports 36 therebetween for the passage of toothpaste.

Figure 4:
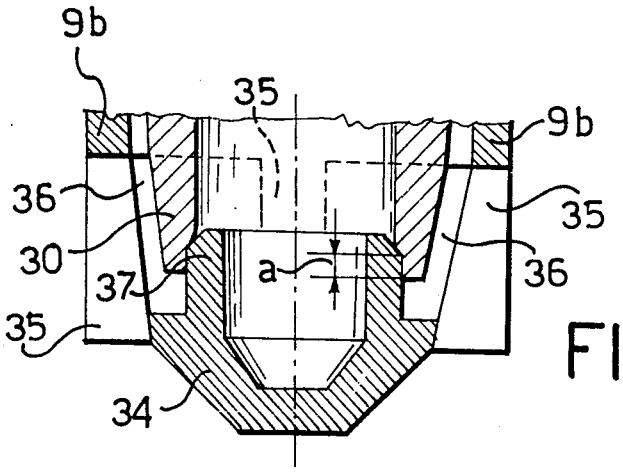
FIG. 4 is a sectional view, drawn to a further enlarged scale, of a detail of the device shown in FIG. 3.

In one embodiment shown in FIGS. 3, 4 and 5, the shutter 34 includes a cylindrical portion 37 coaxial with the axis X—X which fits plug-like into the conduit 27.

It should be noted that the cylindrical portion 37 is inserted into the conduit 27 for a predetermined distance, indicated at "a", with the lever 19 at its home position.

It is immediately disengaged from the inlet mouth 28 upon the lever 19 reaching its intermediate position, and is instead removed by a predetermined distance, designated "b" in FIG. 5, with the lever 19 at its dispensing end positoin.

In accordance with the invention, the membrane 10, sleeve 9, shutter 34 with its cylindrical portion 37, and bridges 35 are a unitary construction, preferably molded from a suitable plastics such as a thermoplastic elastomer.

According to another embodiment of the invention, shown in FIGS. 6, 7, 8 and 9, the shutter 34 is configured plate-like and formed with a conical surface 38 which extends from a flat annular rim 39 facing the conduit 27.

Figure 8:
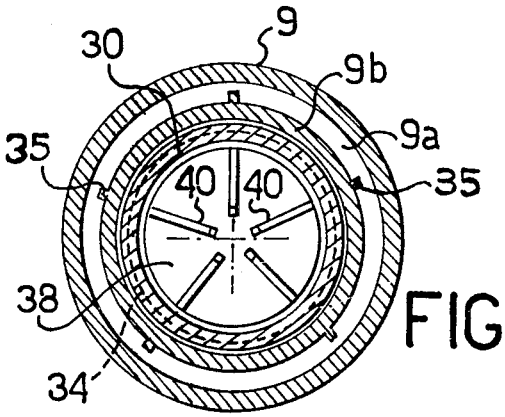
FIG. 8 is a sectional view drawn along the line VIII—VIII of FIG. 6.
Figure 7:
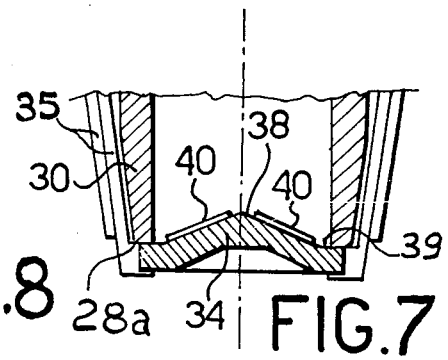
FIG. 7 shows in section and to a further enlarged scale a detail of the device of FIG. 6.
Figure 9:
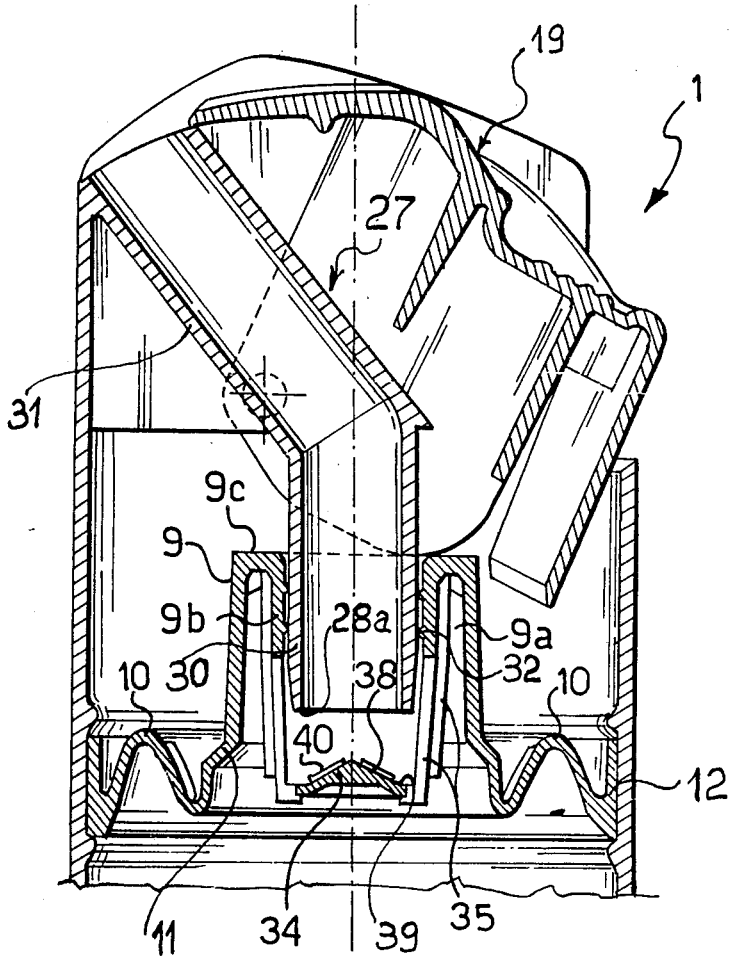
FIG. 9 is a sectional view showing the device of FIG. 6 at another stage of its operation.

The latter would be closed by the flat rim 39 engaging with the free edge 28*a* of the inlet mouth 28. The conical surface 38, is as shown in FIGS. 7 and 8, provided with a plurality of radial ribs 40 which, in cooperation with the edge 28*a* of the inlet mouth 28 during the approach phase of the shutter 34 operation, cause it to be centered and contribute therefore toward proper engagement of the flat annular rim 39 with the inlet mouth 28.

In order to dispense a desired amount of the toothpaste, the actuating lever 19 is depressed through a first angle of rotation about the axis Y—Y from the home position to the dispensing start position. During this first displacement of the lever 19, the eave 33 will move away from and uncover the outlet mouth 29, while the shutter 34 disengages itself from the inlet mouth 28.

During this phase, the membrane 10 is operated by the axial displacement of the sleeve 9 as brought about by the lever 19 to push on the toothpaste and be slightly deformed.

As the lever 19 is further actuated through its angular displacement from the dispensing start position to the dispensing end position (see FIGS. 5 and 9), while the shutter 34 moves further away from the inlet mouth 28 to free it completely, the membrane 10 causes, by virtue of its deformation, the toothpaste to flow upwards through the ports 36 and conduit 27 to the outlet mouth 29.

On releasing the lever 19, the membrane 10, owing to its elastic return bias, resumes its original configuration and returns the sleeve 9 upwards, thus taking the lever 19 back to its home position and causing the outlet mouth 29 to be covered by the eave 33 while the shutter 34 is engaged at the same time with the inlet mouth 28.

As the membrane 10 resumes its original configuration, the movable bottom 5 is driven upwards, in a manner known per se, by the atmospheric pressure outside the dispenser.

Figure 10:
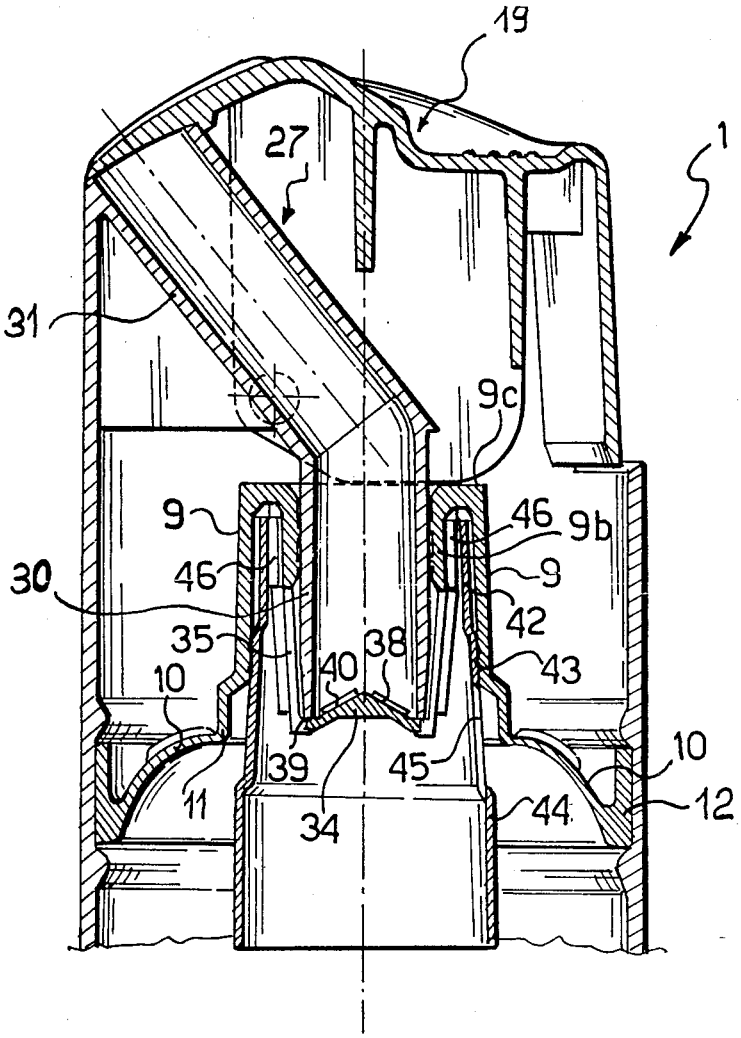
FIG. 10 is a sectional view of the embodiment of the head assembly of FIG. 6 including an accessory item for dispensing two different paste types and forming superimposed strips from the two paste types.
Figure 11:
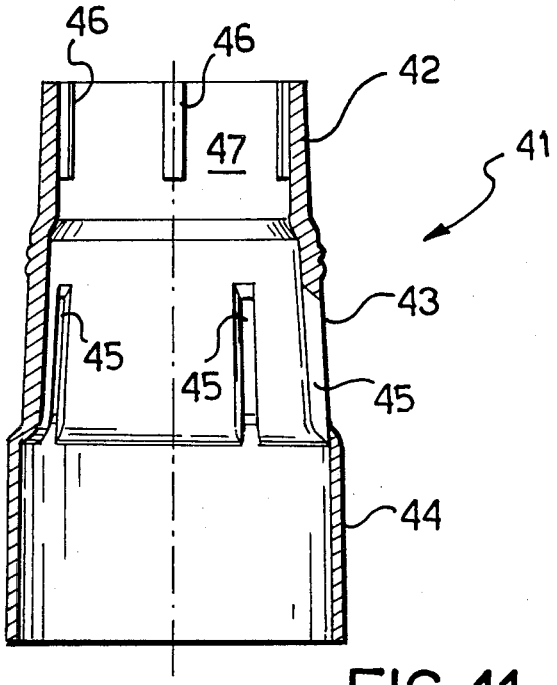
FIG. 11 is an enlarged scale longitudinal section view of the accessory item incorporated to the device of FIG. 10 drawn along the line XI—XI of FIG. 12.
Figure 12:
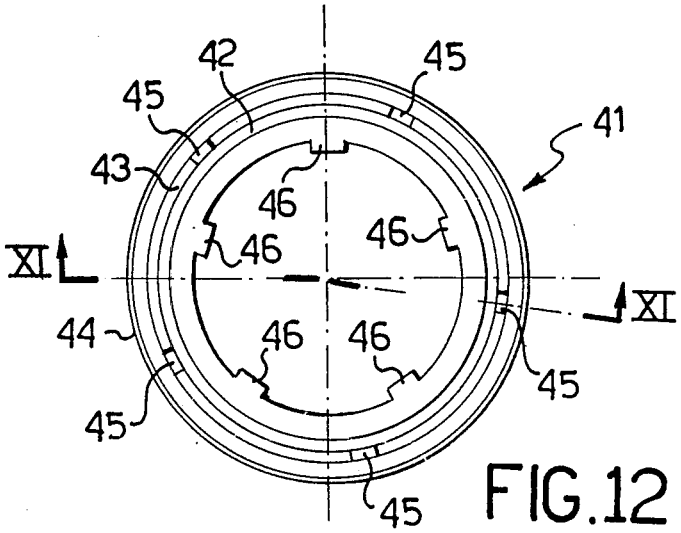
FIG. 12 is a plan view of the accessory item shown in FIG. 11.

With reference to FIG. 10, it should be noted that the device of this invention allows for the installation of an accessory item, e.g. of the kind shown in FIGS. 11 and 12, for simultaneously dispensing two different toothpaste types, e.g. with different colors, to form superimposed strips of one toothpaste type over the other.

This accessory item consists, with reference to Figures 11 and 12, of an element 41 having a generally tubular configuration with different diameters.

The element 41 includes a first, slightly flaring section 42, a second section 43 with a larger diameter and being also slightly flared, but to a wider flare angle than the first section, and a third section 44 having a yet larger diameter than the preceding section and a flare angle substantially equal to that of the first section 42.

The intermediate section 43 is formed with radial openings 45, and the first section 42 is provided with a plurality of longitudinal ribs 46 formed radially to extend toward the interior of the tubular cavity 47.

The tubular element 41, when a striped paste delivery is requested, would be fitted with its section 42 into the annular groove 9a of the sleeve 9, wherein it is retained by the frictional resistance created between the ribs 46 and the inner surface of the groove 9a.

An optionale toothpaste of a different nature or color intended for stripe forming, would be loaded conventionally into the annular region 48 of the container 2 encircling the section 44 which juts out from the membrane 10.

In operation, as the main toothpaste is being pushed by the membrane 10 through the axial cavity 47 in the tubular element 41, the optional or accessory toothpaste directed to provide such stripes is pushed by the membrane 10 itself through the radial openings 45, whose circumferential dimensions will determine the width of the stripes, and converges toward the opening 28 to overlap the main flow.

As may be appreciated from the foregoing description, the main advantage afforded by a dispenser according to this invention resides in that a paste contained therein can be kept intact over long time intervals from its packaging to its first use.

In fact, by virtue of the closure provided by the shutter 34 in the conduit 27, any contact of the toothpaste with atmospheric air is avoided which would results in its drying and deteriorating.

In fact, during the conventional process of filling the dispenser from its bottom, toothpaste is effectively prevented from leaking into the conduit 27 whose closure, as provided by the eave 33, cannot by its very nature ensure an air tight fit.

An additional advantage of the dispenser according to the invention is that its pumping member is structured to also permit of two different toothpastes being dispensed at one time, to form stripes of one paste over the other, following attachment of an appropriate accessory.

Understandably, the above-disclosed dispenser may be in many ways altered and modified by a skilled person in the art, for the purpose of meeting specific contingent demands, without departing from the true scope of the invention as set forth in the appended claims.

What I claim is:

1. A dispenser of paste-like products, in particular toothpaste, comprising a cylindrical container having a vertical longitudinal axis, a head located at the container upper end, a bottom wall mounted for tight sliding movement inside the container in one direction toward the head, a pumping member mounted on the container close against the head, a sleeve-like element having a free end and an opposed end associated with the pumping member, an actuating lever for moving the pumping member, trunnions protruding from the lever along a perpendicular pivot axis to the container longitudinal axis, said pivot axis being fixed relatively to the container, said lever being movable angularly about said pivot axis from a home position to a paste delivery position, trunnion bearing seats formed in the head for accomodating said trunnions, a tubular delivery conduit having an inlet mouth and an outlet mouth and being stationarily fixed relative to the head, said tubular delivery conduit being connected to said sleeve-like element at its inlet mouth, a covering eave formed integrally with said actuating lever and extending to cover the outlet mouth when the lever is at its home position, said actuating lever being provided with a cam shaped portion for engagement with said free end of the sleeve-like element for sliding the sleeve-like element in an axial direction along the inlet mount upon movement of the actuating lever to its paste delivery position, said pumping member comprising a flexible annular membrane having an outward edge held axially to the cylindrical container and an inward edge connected to said sleeve-like element, and a shutter connected to said sleeve like member for closing the inlet mouth of said delivery conduit when the actuating lever is at said home position and to open it when said actuating lever is moved from said home position to said paste delivery position.

2. A dispensing according to claim 1, in which said sleeve-like element associated with said pumping member has an annular groove formed therein and open towards the bottom of the container, said groove defining a concentrical tubular wall facing said delivery conduit with a free edge towards the container bottom.

3. A dispenser according to claim 2, in which said tubular wall has annular ribs arranged to face said delivery conduit for providing a tight sliding contact between the conduit and the sleeve-like element.

4. A dispenser according to claim 2, in which said shutter is connected to the free edge of said concentrical tubular wall of the sleeve-like element by means of a plurality of bridges spaced apart to define passage ports.

5. A dispenser according to claim 1, in which said shutter comprises a cylindrical element located at a position to be coaxial with the inlet mouth of the delivery conduit and having an outside diameter selected for plugging said inlet mouth.

6. A dispenser according to claim 1, in which said shutter comprises a plate-like element having a flat annular rim facing the inlet mouth of said delivery conduit for face abutment with an edge of the inlet mouth when in the closed position, and inclined ribs formed in its center area concentrical with said inlet mouth and arranged to face the latter for centering the shutter as is moves to a closed position.

7. A dispenser of paste-like products, in particular toothpaste, comprising a cylindrical container having a vertical longitudinal axis, a head located at the container upper end, a bottom wall mounted for tight sliding movement inside a container in one direction toward the head, a pumping member mounted on the container close against the head, a sleeve-like element having a free end and an opposed end associated with the pumping member, said sleeve-like element having an annular groove formed therein and open towards the bottom of the container, an actuating lever for moving the pumping member, trunnions protruding from the lever along a perpendicular pivot axis to the container longitudinal axis, said pivot axis being fixed relatively to the container, said lever being movable angularly about said pivot axis from a home position to a paste delivery position, trunnion bearing seats formed in the head for accomodating said trunnions, a tubular delivery conduit having an inlet mouth and an outlet mouth and being stationarily fixed relative to the head, said tubular delivery conduit being connected to said sleeve-like element at its inlet mouth, a covering eave formed integrally with said actuating lever and extending to cover the outlet mouth when the lever is at its home position, said actuating lever being provided with a cam shaped portion for engagement with said free end of the sleeve-like element for sliding the sleeve-like element in an axial direction along the inlet mouth upon movement of the actuating lever to its paste has been inserted between "direction", said pumping member comprising a flexible annular membrane having an outward edge held axially to the cylindrical container and an inward edge connected to said sleeve-like element, a shutter connected to said sleeve-like member for closing the inlet mouth of said delivery conduit when the actuating lever is at said home position and to open it when said actuating lever is moved from said home position to said paste delivery position and a tubular element having one end inserted removably into said annular groove of the sleeve-like element and the opposed end protruding free into the container concentrically with said shutter, said tubular element being provided with a pluralityof spaced-apart radial openings extending longitudinally across a mid portion of the longitudinal extent thereof.

8. A dispenser according to claim 7, in which said tubular element comprises a flared first section engaged frictionally within said annular groove, a second, flared section having larger diameter and flare angle than the first section, and a third, flared section facing the inner side of the container and having a larger diameter than the first and second sections and a flare angle which is substantially the same as the flare angle of the first section.

9. A dispenser according to claim 8, in which the first section of said tubular element has longitudinal ribs formed radially on the inner surface thereof.

* * * * *